US011845122B2

(12) United States Patent
Zhou et al.

(10) Patent No.: US 11,845,122 B2
(45) Date of Patent: Dec. 19, 2023

(54) STAMPING MACHINE AND METHOD INCLUDING VARIABLE BINDER GAP

(71) Applicants: Dajun Zhou, Troy, MI (US); Kaiping Li, Shelby Township, MI (US); Robert D Miller, Lake Orion, MI (US); Richard J Siemen, Shelby Township, MI (US); Yongiun Zhou, Rochester Hills, MI (US)

(72) Inventors: Dajun Zhou, Troy, MI (US); Kaiping Li, Shelby Township, MI (US); Robert D Miller, Lake Orion, MI (US); Richard J Siemen, Shelby Township, MI (US); Yongiun Zhou, Rochester Hills, MI (US)

(73) Assignee: FCA US LLC, Auburn Hills, MI (US)

( * ) Notice: Subject to any disclaimer, the term of this patent is extended or adjusted under 35 U.S.C. 154(b) by 182 days.

(21) Appl. No.: 17/102,882

(22) Filed: Nov. 24, 2020

(65) Prior Publication Data

US 2022/0161307 A1 May 26, 2022

(51) Int. Cl.
*B21D 24/08* (2006.01)
*B21D 22/22* (2006.01)

(52) U.S. Cl.
CPC ..... *B21D 24/08* (2013.01); *B21D 22/22* (2013.01)

(58) Field of Classification Search
CPC ..... B21D 22/22; B21D 24/04; B21D 24/06; B21D 24/08
See application file for complete search history.

(56) References Cited

U.S. PATENT DOCUMENTS 4,576,030 A * 3/1986 Roper ..... B21D 22/02 72/305
9,914,164 B1 3/2018 Siekirk, III et al.
(Continued)

FOREIGN PATENT DOCUMENTS

DE 10334483 A1 * 3/2005 ..... B21D 22/22
DE 102008017728 A1 * 10/2009 ..... B21D 22/22
(Continued)

OTHER PUBLICATIONS

Machine translation of DE 102008017728, Retrieved from Search Oct. 17, 2022, 5 Pages. (Year: 2009).*
(Continued)

*Primary Examiner* — Katrina M Stransky
*Assistant Examiner* — Jared O Brown
(74) *Attorney, Agent, or Firm* — Jeremy J. Klobucar

(57) ABSTRACT

A stamping machine configured to shape a sheet material including an upper binder including first teeth, a lower binder including second teeth, and a punch. A first cylinder is positioned between a lower binder and a support surface. A second cylinder is positioned between the upper binder and the lower binder. A cushion pin is positioned at the support surface that is configured to contact and control movement of the lower binder relative to the punch. A force exerted by the second cylinder is greater than that exerted by the first cylinder, and the force exerted by the cushion pin is greater than that exerted by the second cylinder. The first and second cylinders and the cushion pin are used to control when the first and second teeth are permitted to engage the sheet material, which assists in preventing or minimizing spring back of the sheet material through post-stretching.

14 Claims, 6 Drawing Sheets

(56) References Cited

U.S. PATENT DOCUMENTS

| | | | | |
|---|---|---|---|---|
| 10,786,842 | B2 * | 9/2020 | Zhou | B21D 24/005 |
| 2011/0094283 | A1 * | 4/2011 | Flehmig | B21D 22/22 72/347 |
| 2018/0009018 | A1 * | 1/2018 | Huang | B21D 22/02 |
| 2020/0078846 | A1 * | 3/2020 | Zhou | B21D 24/16 |
| 2020/0197997 | A1 * | 6/2020 | Zhou | B21D 25/02 |

FOREIGN PATENT DOCUMENTS

| | | | |
|---|---|---|---|
| KR | 20090010448 | A * | 1/2009 |
| KR | 101611735 | B1 * | 4/2016 |

OTHER PUBLICATIONS

Machine translation of KR 101611735, Retrieved from Search Oct. 17, 2022, 9 Pages. (Year: 2016).*
Machine translation of KR 20090010448, Retrieved from Search Oct. 17, 2022, 5 Pages. (Year: 2009).*
Machine translation of DE 10334483, Retrieved from Espacenet Oct. 17, 2022, 10 Pages. (Year: 2005).*

* cited by examiner

STAMPING MACHINE AND METHOD INCLUDING VARIABLE BINDER GAP

FIELD

The present disclosure relates a stamping machine and a method of stamping a sheet material.

BACKGROUND

Traditionally, machines used stamping techniques to stamp sheet material that lead to spring back in the sheet material. Spring back is the geometric change made to the sheet material at the end of the forming process when the sheet material has been released from the machine. Upon completion of the stamping operation, the sheet material springs back thereby affecting the accuracy of the finished sheet material. Modern machines and stamping techniques (e.g., stake beading) reduce spring back at the expense of wasting sheet material. Thus, there is a need for a machine and stamping operation that eliminates or at least substantially minimizes spring back in the stamped material while avoiding waste material.

SUMMARY

According to a first aspect of the present disclosure, there is provided a stamping machine that is configured to shape a sheet material. The stamping machine includes a punch fixed to a support surface; an upper binder that is movable relative to the punch, and defining a cavity that is shaped to correspond to a shape of the punch; a lower binder located about a periphery of the punch, the lower binder being movable relative to the punch; a first cylinder positioned between the lower binder and the support surface, the first cylinder supporting the lower binder as it moves relative to the punch; a second cylinder positioned between the upper binder and the lower binder; a cushion pin positioned at the support surface that is configured to contact and control movement of the lower binder relative to the punch, first teeth formed on upper binder; and second teeth formed on the lower binder that are opposed to and correspond to the first teeth. A force exerted by the second cylinder is greater than that exerted by the first cylinder, and the force exerted by the cushion pin is greater than that exerted by the second cylinder. In a first stage where the upper binder is moved in a direction toward the punch, the lower binder is moved by the second cylinder against the force exerted by the first cylinder to an extent that a gap is maintained between the first teeth and the second teeth that ensures that the first and second teeth do not grip the sheet material, and in a second stage where the upper binder is continued to be moved toward the punch, the lower binder is moved by the second cylinder against the force exerted by the first cylinder until the lower binder contacts the cushion pin, and upon contact by the lower binder with the cushion pin, the gap between the first and second teeth is removed such that the first and second teeth grip and hold the sheet material. In this manner, by controlling the moment at which the sheet material is gripped by the first and second teeth, a draw-in movement of the sheet material toward the cavity can be controlled, which allows spring back of the sheet material during the stamping process to be more easily controlled and mitigated.

According to a second aspect of the present disclosure there is provided a method of stamping a sheet material that includes placing a sheet material in a stamping machine, wherein the stamping machine includes a punch fixed to a support surface; an upper binder that is movable relative to the punch, and defining a cavity that is shaped to correspond to a shape of the punch; a lower binder located about a periphery of the punch, the lower binder being movable relative to the punch; a first cylinder positioned between the lower binder and the support surface, the first cylinder supporting the lower binder as it moves relative to the punch; a second cylinder positioned between the upper binder and the lower binder; a cushion pin positioned at the support surface that is configured to contact and control movement of the lower binder relative to the punch; and first teeth formed on upper binder and second teeth formed on the lower binder that are opposed to and correspond to the first teeth, wherein a force exerted by the second cylinder is greater than that exerted by the first cylinder, and the force exerted by the cushion pin is greater than that exerted by the second cylinder. The method also includes moving the upper binder in a direction toward the punch such that the lower binder is moved by the second cylinder against the force exerted by the first cylinder to an extent that a gap is maintained between the first teeth and the second teeth that ensures that the first and second teeth do not grip the sheet material; and continuing to move the upper binder toward the punch such that the lower binder is moved by the second cylinder against the force exerted by the first cylinder until the lower binder contacts the cushion pin, wherein upon contact by the lower binder with the cushion pin, the gap between the first and second teeth is removed such that the first and second teeth grip and hold the sheet material. In this manner, by controlling the moment at which the sheet material is gripped by the first and second teeth, spring back of the sheet material during the stamping process can be more easily controlled and mitigated.

According to a third aspect of the present disclosure, there is provided a stamping machine that is configured to shape a sheet material. The stamping machine includes a punch fixed to a support surface; an upper binder that is movable relative to the punch, and defining a cavity that is shaped to correspond to a shape of the punch; a lower binder located about a periphery of the punch, the lower binder being movable relative to the punch; a hydraulic cylinder positioned between the upper binder and the lower binder; a fluid tank in communication with the hydraulic cylinder via a valve; a switch that is operable to open and close the valve; first teeth formed on upper binder; and second teeth formed on the lower binder that are opposed to and correspond to the first teeth. In a first stage where the upper binder is moved in a direction toward the punch, the valve is in a closed position and the lower binder is moved by a force exerted by the hydraulic cylinder against the lower binder to maintain a gap between the first teeth and the second teeth that ensures that the first and second teeth do not grip the sheet material. In a second stage where the upper binder is continued to be moved toward the punch, the lower binder is moved by the hydraulic cylinder until the lower binder contacts the switch to open the valve and permit a fluid to flow from the hydraulic cylinder to the fluid tank, which permits the hydraulic cylinder to compress and allow the upper binder to move toward the lower binder until the gap between the first and second teeth is removed such that the first and second teeth grip and hold the sheet material.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

Example embodiments will now be described more fully with reference to the accompanying drawings.

Figure 1:
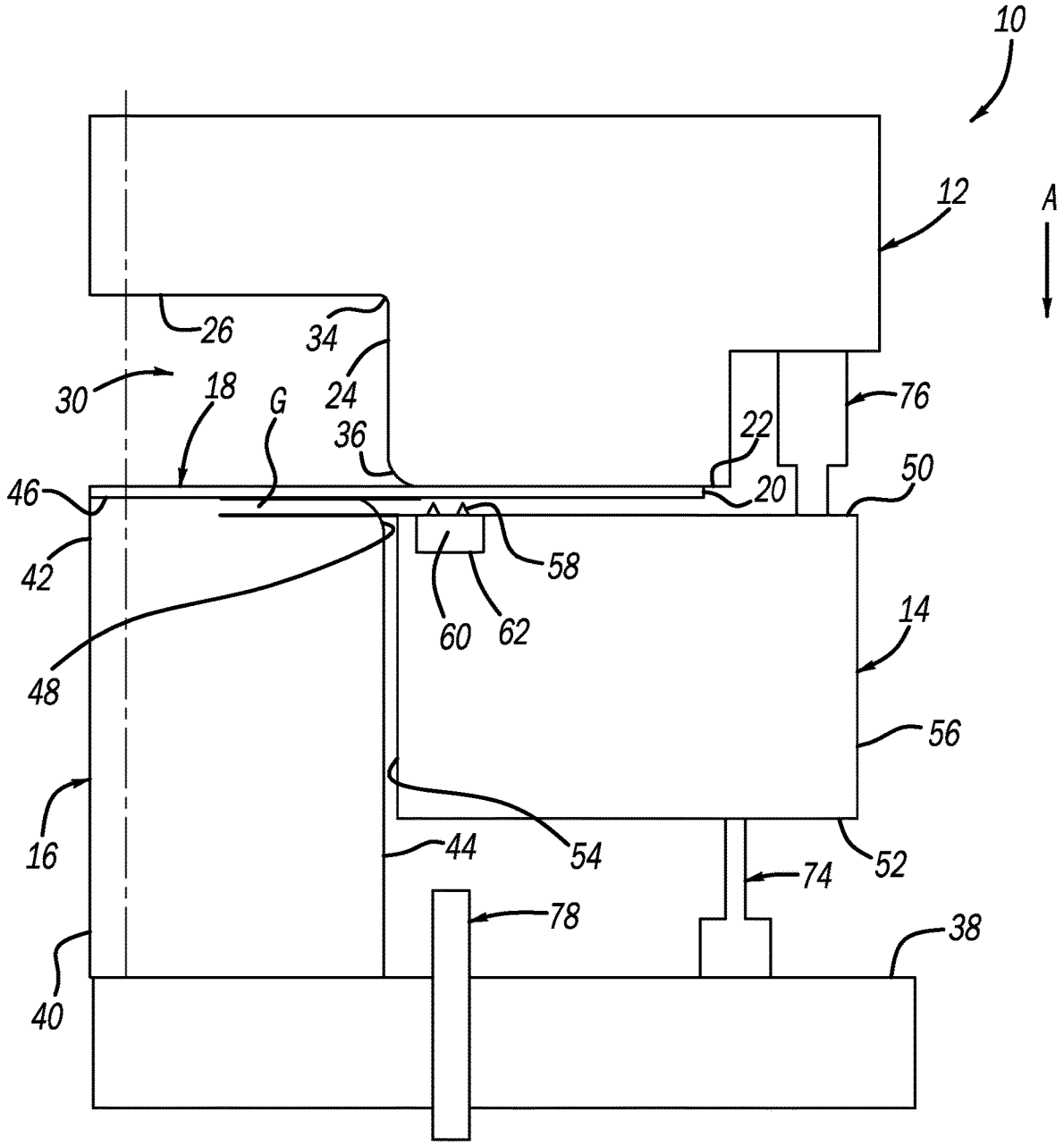
FIG. 1 is a schematic illustration of a stamping machine according to a principle of the present disclosure during a first stage of a stamping operation.
Figure 2:
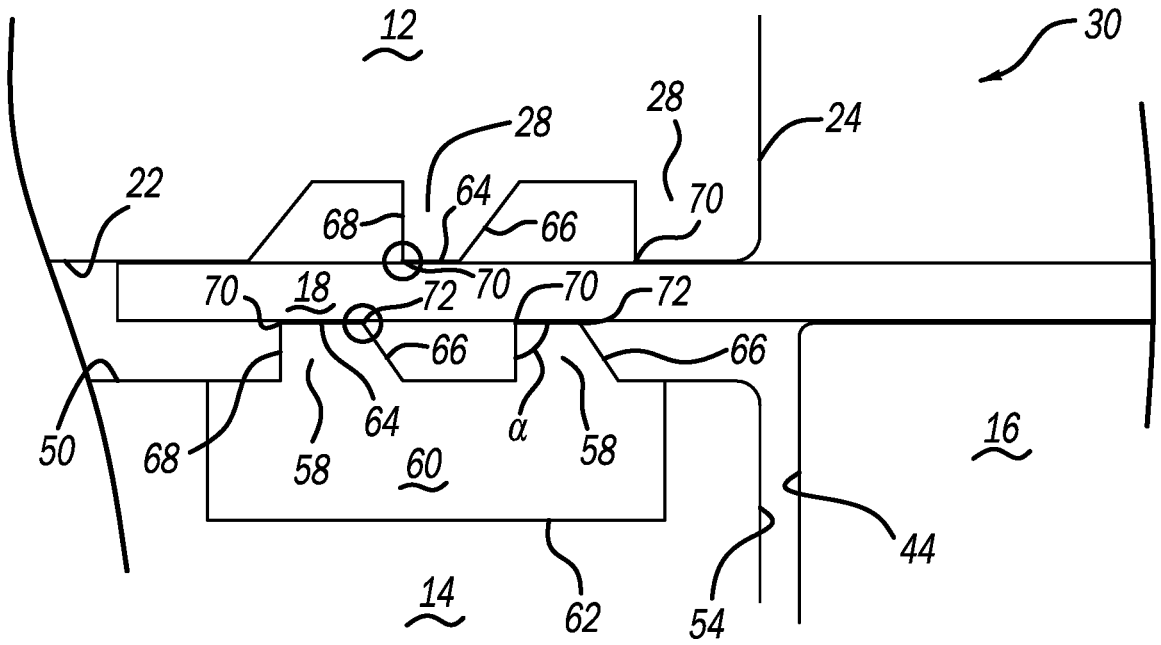
FIG. 2 is a schematic illustration of a plurality of teeth formed on an upper binder and a lower binder of the stamping machine illustrated in FIG. 1.
Figure 3:
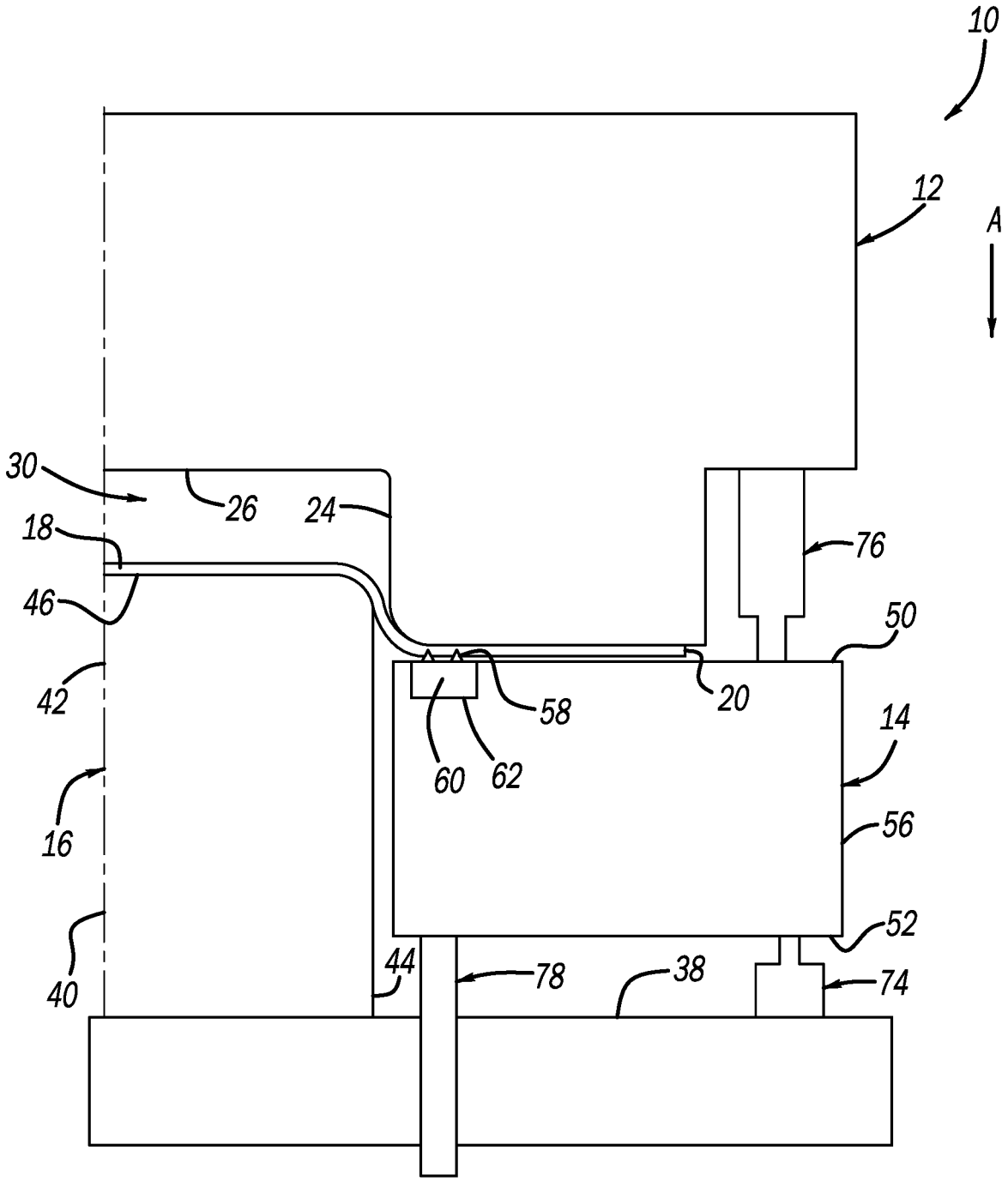
FIG. 3 is a schematic illustration of a stamping machine according to a principle of the present disclosure during a second stage of the stamping operation.
Figure 4:
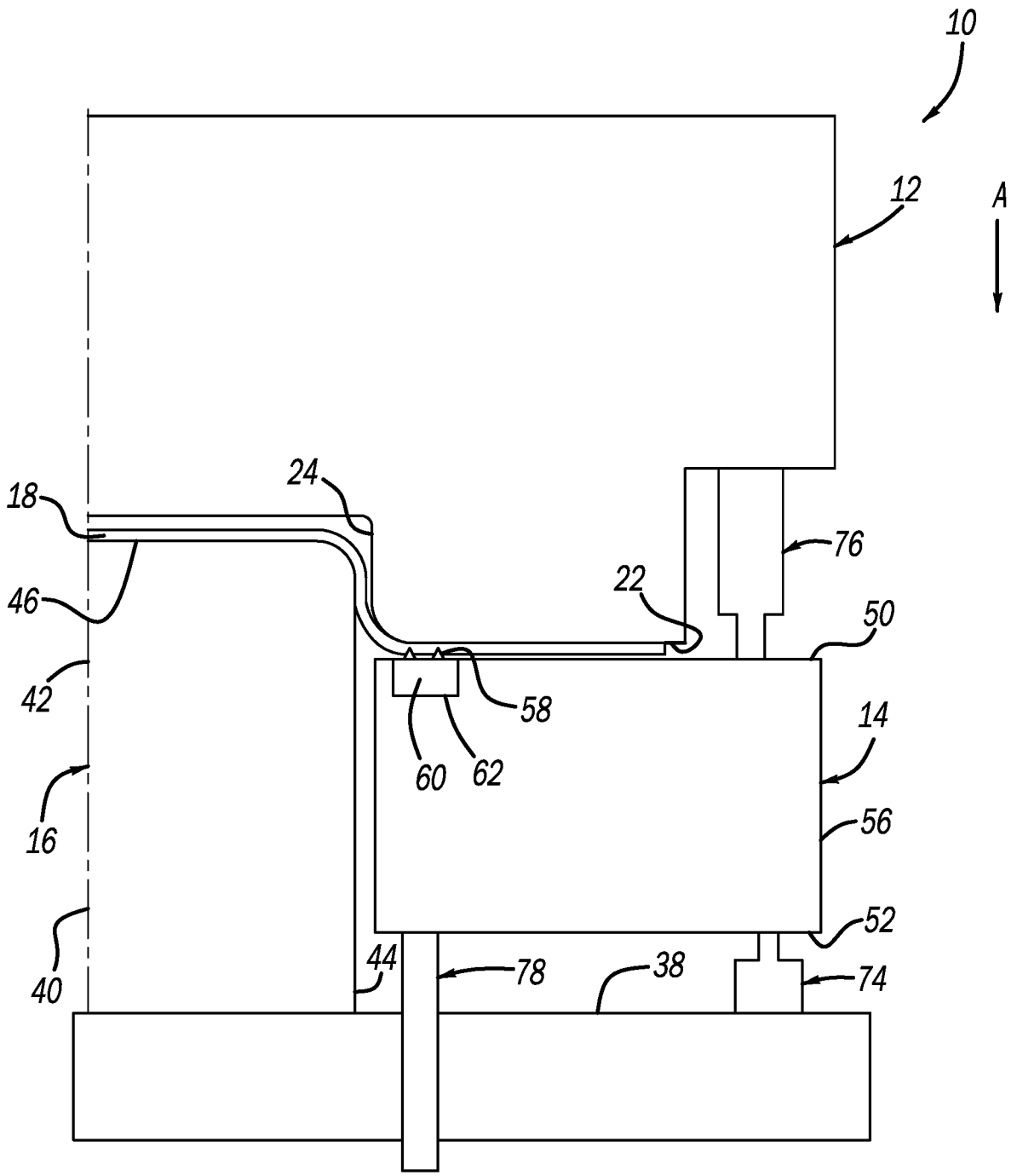
FIG. 4 is a schematic illustration of a stamping machine according to a principle of the present disclosure during a third and final stage of the stamping operation.

FIGS. 1-4 illustrate a machine 10 configured to conduct a stamping operation. FIGS. 1, 3, and 4 only illustrate half of the machine 10. It should be understood, however, that the omitted half of the machine 10 is a mirror image of the illustrated half. Machine 10 includes an upper binder 12, a lower binder 14, and a punch 16. Lower binder 14 extends about a periphery of punch 16, and both upper binder 12 and lower binder 14 are movable relative to punch 16, which is fixed in the illustrated embodiment. It should be understood, however, that upper binder 12 may be fixed, and lower binder 14 and punch 16 may be movable relative to upper binder 12 without departing from the scope of the present disclosure. A sheet material 18 (e.g., sheet metal) is located between upper binder 12 and punch 16, with an outer periphery 20 of the sheet material 18 being supported by lower binder 14. As will be described in more detail below, the lower binder 14 cooperates with upper binder 12 to grip the sheet material 18 when the upper binder 12 is driven downwardly (in the direction A) along the punch 16 to restrict or limit the lateral movement of the sheet material 18 relative to the punch 16 while allowing axial stretching (i.e., in a direction parallel with direction A) of a portion of the sheet material 18.

Upper binder 12 is generally U-shaped and formed of a metallic material. Upper binder 12 includes a sheet material contact surface 22, inside walls 24, and an upper cavity surface 26. As best shown in FIG. 2, sheet material contact surface 22 includes upper teeth 28 on a portion thereof. The sheet material contact surface 22 extends parallel to the upper cavity surface 26. The inside walls 24 cooperate with the upper cavity surface 26 to form a cavity 30. The inside walls 24 extend parallel to each other and perpendicular to the upper cavity surface 26 and the sheet material contact surface 22. The inside walls 24 include inner and outer radii 34, 36 that attach to the upper cavity surface 26 and the sheet material contact surface 22, respectively. The upper cavity surface 26 faces the sheet material 18 positioned on the punch 16 and the lower binder 14.

Punch 16 is fixed on a support surface 38 and made out of a metal material. Punch 16 is received inside the cavity 30 of the upper binder 12 an initial distance when the upper binder 12 is driven downwardly along the punch 16 the initial distance and is received therein a greater distance when the upper binder is driven downwardly along the punch 16 a remaining distance. The punch 16 includes a lower end 40 and an upper end 42. The lower end 40 is positioned on the support surface 38 beneath the upper end 42.

Upper end 42 of punch 16 is aligned with the cavity 30 of the upper binder 12 and is shaped to be received within the cavity 30. The upper end 42 includes outer walls 44 and an engagement surface 46. The outer walls 44 extend parallel to the inside walls 24 of the upper binder 12 and extend perpendicular to the engagement surface 46. The outer walls 44 are adjacent to the inside walls 24 of the upper binder 12 when the upper end 42 is received within the cavity 30. The outer walls 44 include punch radii 48 that are connected to the engagement surface 46. The engagement surface 46 is disposed inside the cavity 30 of the upper binder 12 when the upper end 42 is received within the cavity 30.

Lower binder 14, as noted above, extends around a periphery of punch 16, is movable relative to punch 16, and is formed of a metallic material. Lower binder 14 includes an upper engagement surface 50 that is parallel with sheet material contact surface 22 of upper binder 12, and an opposing lower surface 52 that is parallel with upper engagement surface 50. Inner and outer side surfaces 54, 56 connect upper engagement surface 50 and lower surface 52, with inner side surface 54 extending adjacent to outer walls 44 of punch. Upper engagement surface 50, as best shown in FIG. 2, includes lower teeth 58 that are configured to cooperate with upper teeth 28 to grip sheet material 18 during the stamping process, as will be described in more detail later. Lower teeth 58 may be unitary with lower binder 14. That is, lower teeth 58 may be formed from the same material and at the same time that lower binder 14. Alternatively, as illustrated, lower teeth 58 may be formed as part of an insert 60 that is removable from lower binder 14. In this regard, lower binder 14 may include a recess 62 configured for receipt of insert 60. In this regard, as lower teeth 58 begin to wear during repeated use, insert 60 may be removed and replaced by another insert 60 including lower teeth 58. In this manner, machine down time is avoided and increased productivity can be obtained.

FIG. 2 illustrates upper teeth 28 formed on upper binder 12, and lower teeth 58 of insert 60 that is located within recess 62 of lower binder 14. In the illustrated embodiment, insert 60 includes a pair of lower teeth 58 and upper binder 12 includes a pair of upper teeth 28. It should be understood, however, that a greater or lesser number of upper and lower teeth 28, 58 are contemplated. In any event, upper and lower teeth 28, 58 are complementary such that the lower teeth 58 fits between upper teeth 28 when sheet material 18 is gripped between upper and lower teeth 28, 58.

Each tooth of upper and lower teeth 28, 58 include a material engagement surface 64, a first side surface 66 that faces the punch 16, and a second side surface 68 that faces away from punch 16. A sharp corner 70 is formed at the intersection between material engagement surface 64 and second side surface 68. Sharp corners 70 are configured to bite into the sheet material 18 during compression of the sheet material 18 between upper and lower teeth 28, 58. An angle α between material engagement surface 64 and second side surface 68 that defines sharp corner 70 may be about ninety degrees, or may be acutely angled. If the angle α is acutely angled, the angle α may lie in the range of seventy degrees to about eighty degrees.

A rounded or bending corner 72 is formed at the intersection between material engagement surface 64 and first side surface 66. Rounded corner 72 is configured to bend sheet material 18 when sheet material 18 is gripped between upper and lower teeth 28, 58, and permit sharp corners 70 of another tooth of the upper and lower teeth 28, 58 to bite into the sheet material 18. More specifically, the rounded corner 72 of lower tooth 58 that is circled in FIG. 2 bends the sheet material 18 to an extent that the sharp corner 70 that is circled in FIG. 2 can bite into the sheet material 18. In this manner, the sheet material 18 is strongly gripped between upper and lower teeth 28, 58 to stop the draw-in movement of the sheet material 18 in a direction toward cavity 30, permit the sheet material 18 to stretch when engaged by punch 16, and create a post-stretch force that limits the amount of spring back.

Again referring to FIG. 1, machine 10 includes a first cylinder 74 that supports lower binder 14 and a second cylinder 76 that extends between upper binder 12 and lower binder 14. Each of the first cylinder 74 and second cylinder 76 may be a hydraulic cylinder, each of the first and second cylinders 74, 76 may be a gas spring cylinder such as a nitrogen gas spring cylinder, or one of the first and second cylinders 74, 76 may be a hydraulic cylinder while the other is a gas spring cylinder. Alternatively, a spring such as a coil spring may be used in place of first and second cylinders 74, 76. In any event, second cylinder 76 is configured to exert a force that is greater than that exerted by first cylinder 74. First cylinder 74 extends between support surface 38 and lower surface 52 of binder 14. Second cylinder 76 extends between upper engagement surface 50 of lower binder 14 and upper binder 12. Machine 10 also includes a third cylinder or cushion pin 78 located at support surface 38 beneath lower binder 14. Cushion pin 78 is configured to exert a force that is greater than that exerted by both first cylinder 74 and second cylinder 76. Although not shown in the figures, it should be understood that upper binder 12 includes a drive mechanism that moves upper binder 12 in the direction A.

Operation of machine 10 will now be described. In a first stage where upper binder 12 is actuated downward in the direction A by the drive mechanism (not illustrated), lower binder 14 will begin to be actuated downward through the force exerted by second cylinder 76, which is greater than the force exerted by first cylinder 74, and which will cause first cylinder 74 to begin to retract. As first cylinder 74 retracts, a gap G is maintained between sheet material contact surface 22 of upper binder 12 and upper engagement surface 50 of lower binder 14. Thus, while sheet material 18 is not gripped by upper and lower teeth 28, 58, sheet material 18 will begin formation into the final part. In other words, due to the gap G between teeth 28, 58 that prevents the teeth 28, 58 from gripping sheet material 18, the sheet material 18 is permitted to be drawn in a direction toward cavity 30.

Now referring to FIG. 3, as first cylinder 74 continues to retract due to the greater force exerted by second cylinder 76 and the force exerted by the drive mechanism (not shown) continuing to lower the upper binder 12 downward in the direction A, lower surface 52 of lower binder 14 will contact cushion pin 78, which exerts a greater force that both first cylinder 74 and second cylinder 76. Due to the greater force exerted by cushion pin 78, the gap G between upper binder 12 and lower binder 14 will close such that upper and lower teeth 28, 58 will engage and bite into sheet material 18. At this time, the sheet material 18 will be prevented from being drawn in the direction toward cavity 30 and begin to undergo a degree of stretching to form the final part.

Then, referring to FIG. 4, upper binder 12 and lower binder 14 are continued to be moved in the direction A by the drive mechanism (not shown) with the cushion pin 78 in engagement with lower binder 14, which ensures that upper and lower teeth 28, 58 remain in biting engagement with sheet material 18. While upper binder 12 and lower binder 14 are continued to be downward with sheet material 18 locked by teeth 28, 58, the sheet material 18 will undergo final stretching until the final part is formed between upper binder 12 and lower binder 14. After upper binder 12 has fully engaged with punch 16 to form the final part, upper binder 12 may be actuated by drive mechanism (not shown) in direction away from punch 16, which will permit first cylinder 74 to extend away from support surface 38 and move lower binder 14 away from support surface and cushion pin 78. When upper binder 12 is fully opened, the final part may be removed from machine 10.

With above-described configuration, spring back is reduced during formation of the part. Spring back is reduced because the teeth 28, 58 do not grip the sheet material 18 during the initial formation of the part, which allows the sheet material 18 to be drawn in the direction toward cavity 30. That is, by initially maintaining the gap G between upper die 12 and lower die 14 during the stamping operation, the material is permitted to stretch, but also permitted to be drawn toward cavity 30. By allowing the sheet material 18 to be initially stretched and drawn in the direction toward cavity 30, the total amount of force that is applied to the sheet material 18 during the stamping operation is reduced, which assists in preventing split when forming a deep draw part. In this manner, the chance of the sheet material 18 cracking or tearing is reduced. This is particularly advantageous when the sheet material 18 is formed from a material such as a high-strength steel or other high-strength material.

Figure 5:
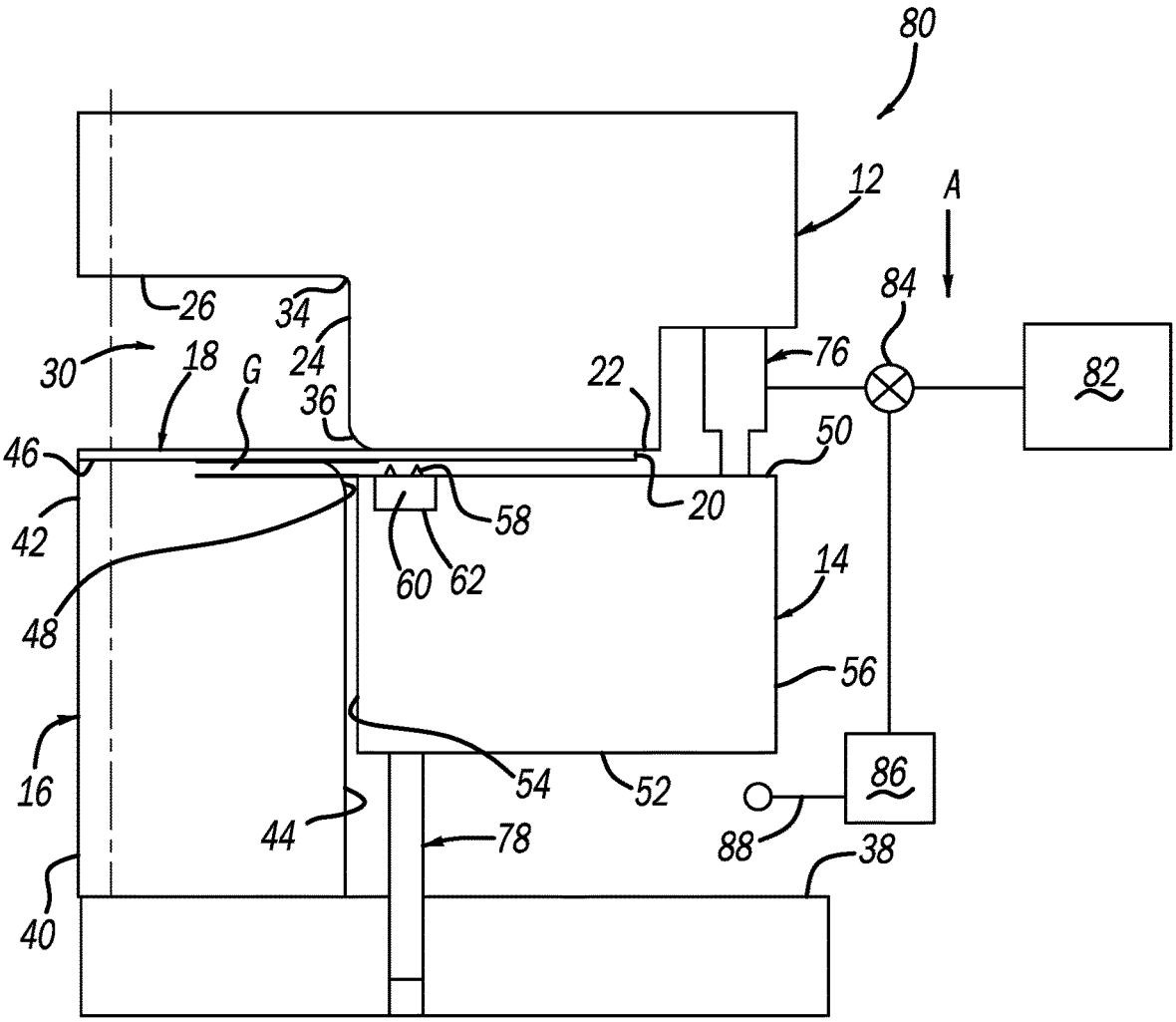
FIG. 5 is a schematic illustration of a stamping machine according to another principle of the present disclosure during a first stage of a stamping operation.
Figure 6:
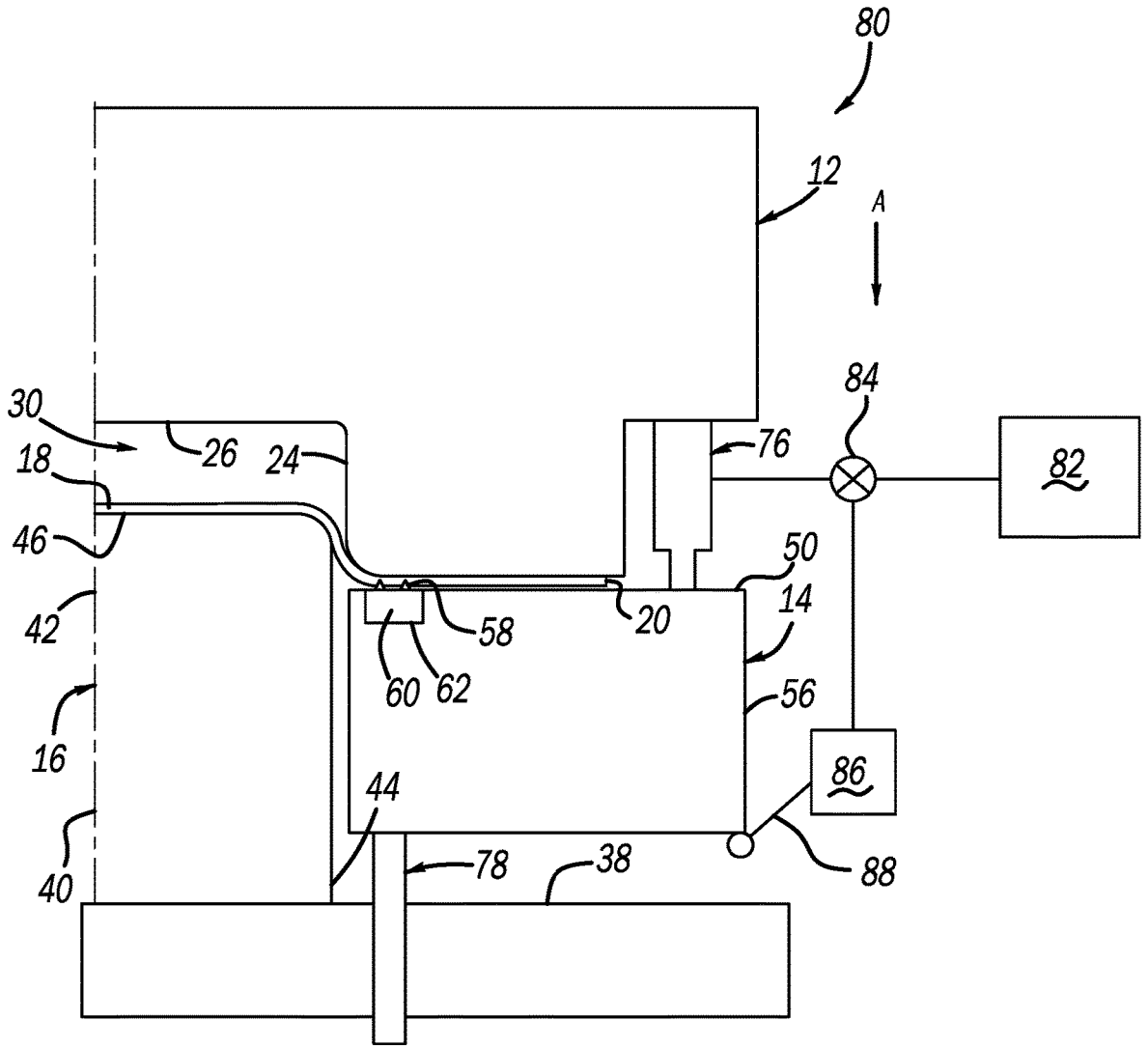
FIG. 6 is a schematic illustration of a stamping machine according to the another principle of the present disclosure during a second stage of the stamping operation.

Now referring to FIGS. 5 and 6, another stamping machine 80 according to a principle of the present disclosure is illustrated. Stamping machine 80 is substantially similar to stamping machine 10 described above. The primary difference between stamping machine 80 and the stamping machine 10 described above is that first cylinder 74 has been omitted and second cylinder 76 is a hydraulic cylinder rather than, for example, a gas spring or a coil spring. In lieu of first cylinder 74, stamping machine 80 includes a fluid-filled reservoir or tank 82 that communicates with second cylinder 76 by an electronically operated valve 84, which may be, for example, a solenoid valve that opens and closes upon application of a voltage. A switch 86 opens and closes valve 84. In the illustrated embodiment, switch 86 is a mechanical switch that includes an arm 88.

In a first stage of the stamping operation that is conducted by machine 80 (FIG. 5), upper binder 12 is actuated downward in the direction A by the drive mechanism (not illustrated). In the first stage, valve 84 is closed, which prevents fluid from second cylinder 78 from flowing into fluid tank 82. Because fluid cannot flow from second cylinder 78 to fluid tank 82, second cylinder 76 acts as a spacer that forces lower binder 14 to move downward along with upper binder 12. Because upper binder 12 and lower binder 14 are moved simultaneously, the gap G is maintained between sheet material contact surface 22 of upper binder 12 and upper engagement surface 50 of lower binder 14 which precludes teeth 28, 58 from gripping sheet material 18. Thus, while sheet material 18 is not gripped by upper and lower teeth 28, 58, sheet material 18 will begin formation into the final part. In other words, due to the gap G between teeth 28, 58 that prevents the teeth 28, 58 from gripping sheet material 18, the sheet material 18 is permitted to be drawn in a direction toward cavity 30.

FIG. 6 illustrates the second stage of the stamping operation. As lower binder 14 continues to be forced downward in the direction A by upper binder 12 via second cylinder 76, the lower surface 52 of lower binder 14 will contact arm 88 of switch 86, which will open valve 84 and permit fluid to flow from second cylinder 76 to fluid tank 82. At substantially the same time or shortly after switch 86 is contacted to open valve 84 and fluid is permitted to flow from second cylinder 76 through the open valve 84 into fluid tank 82, second cylinder 76 will compress and permit upper binder 12 to move closer to lower binder 14. As upper binder 12 moves closer to lower binder 14, the gap G will be removed and teeth 28, 58 will be permitted to grip the sheet material 18 and prevent the sheet material from continuing to draw in a direction toward the cavity 30. Because teeth 28, 58 are preventing the sheet material from drawing toward the cavity 30, the sheet material 18 will begin to undergo a degree of stretching to form the final part. The third stage of the stamping operation will then continue in substantially the same way as shown in FIG. 4, albeit without first cylinder 74.

When the stamping operation is finished, upper binder 12 will begin to be moved upward. Because valve 84 is still in the open position, second cylinder 76 will be permitted to uncompress (i.e., extend by oil re-fill). As second cylinder 76 extends, air pressure in the fluid tank 82 will force fluid through the open valve 84 back into second cylinder 76. Then, as upper binder 14 is pulled upward by second cylinder 76 along with upper binder 12, the pressure on arm 88 will be relieved and permit arm to move switch 86 to the closed position. At this time, valve 84 will close and second cylinder 76 will be ready to conduct another stamping operation.

With above-described configuration, spring back is reduced during formation of the part. Spring back is reduced because the teeth 28, 58 do not grip the sheet material 18 during the initial formation of the part, which allows the sheet material 18 to be drawn in the direction toward cavity 30. That is, by initially maintaining the gap G between upper die 12 and lower die 14 during the stamping operation, the material is permitted to stretch, but also permitted to be drawn toward cavity 30. By allowing the sheet material 18 to be initially stretched and drawn in the direction toward cavity 30, the total amount of force that is applied to the sheet material 18 during the stamping operation is reduced, which assists in preventing split when forming a deep draw part. In this manner, the chance of the sheet material 18 cracking or tearing is reduced. This is particularly advantageous when the sheet material 18 is formed from a material such as a high-strength steel or other high-strength material.

While switch 86 has been described as a mechanical switch that is actuated by contact with lower binder 14, it should be understood that other types of switches may be used in place of switch 86. For example, mechanical switch 86 may be replaced by an optical switch that emits a laser or some other type of beam of light without departing from the scope of the present disclosure. In such a configuration, as lower binder 14 is moved downward and contacts the laser or beam of light, the optical switch will actuate valve 84.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A stamping machine configured to shape a sheet material, comprising:

a punch fixed to a support surface;

an upper binder that is movable relative to the punch, and defining a cavity that is shaped to correspond to a shape of the punch;

a lower binder located about a periphery of the punch, the lower binder being movable relative to the punch;

a first cylinder positioned between the lower binder and the support surface, the first cylinder supporting the lower binder as it moves relative to the punch;

a second cylinder positioned between the upper binder and the lower binder;

a cushion pin positioned at the support surface that is configured to contact and control movement of the lower binder relative to the punch, wherein the cushion pin is a cylinder configured to exert a force that is greater than that exerted by both the first cylinder and the second cylinder first teeth formed on the upper binder; and second teeth formed on the lower binder that are opposed to and correspond to the first teeth;

wherein each tooth of the first and second teeth include a material engagement surface, a first side surface that faces the punch, and a second side surface that faces away from the punch, a rounded corner is located at an intersection between the material engagement surface and the first side surface that faces the punch, and a sharp corner is located at an intersection between the material engagement surface and the second side surface that faces away from the punch, the rounded corners of each of the first teeth are configured to face the sharp corner of an adjacent second tooth when the first and second teeth are engaged with the sheet, a force exerted by the second cylinder is greater than that exerted by the first cylinder, and a force exerted by the cushion pin is greater than that exerted by the second cylinder, in a first stage where the upper binder is moved in a direction toward the punch, the lower binder is moved by the second cylinder against the force exerted by the first cylinder to an extent that a gap is maintained between the first teeth and the second teeth that ensures that the first and second teeth do not grip the sheet material and permits the sheet material to be drawn in a direction toward the cavity, and in a second stage where the upper binder is continued to be moved toward the punch, the lower binder is moved by the second cylinder against the force exerted by the first cylinder until the lower binder contacts the cushion pin, and upon contact by the lower binder with the cushion pin, the gap between the first and second teeth is removed such that the first and second teeth grip and hold the sheet material while permitting the sheet material to undergo final stretching until a final part is formed of the sheet material.

2. The stamping machine according to claim 1, wherein the first and second cylinders are selected from a group consisting of a nitrogen gas spring, a hydraulic cylinder, and a coil spring.

3. The stamping machine according to claim 1, wherein the second teeth are part of an insert that is configured to be received within a recess of the lower binder.

4. The stamping machine according to claim 1, wherein the sharp corner is configured to bite into the sheet material during engagement between the upper teeth and the lower teeth with the sheet material located therebetween.

5. The stamping machine according to claim 4, wherein an angle between the material engagement surface and the second side surface lies in the range of seventy to ninety degrees.

6. The stamping machine according to claim 1, wherein the rounded corner is configured to bend the sheet material during engagement between the upper teeth and the lower teeth with the sheet material located therebetween.

7. The stamping machine according to claim 1, wherein the first and second teeth are configured to limit spring back of the sheet material.

8. A method of stamping a sheet material comprising:

placing a sheet material in a stamping machine, the stamping machine including:

a punch fixed to a support surface;

an upper binder that is movable relative to the punch, and defining a cavity that is shaped to correspond to a shape of the punch;

a lower binder located about a periphery of the punch, the lower binder being movable relative to the punch;

a first cylinder positioned between the lower binder and the support surface, the first cylinder supporting the lower binder as it moves relative to the punch;

a second cylinder positioned between the upper binder and the lower binder;

a cushion pin positioned at the support surface that is configured to contact and control movement of the lower binder relative to the punch, wherein the cushion pin is a cylinder configured to exert a force that is greater than that exerted by both the first cylinder and the second cylinder first teeth formed on the upper binder and second teeth formed on the lower binder that are opposed to and correspond to the first teeth;

wherein each tooth of the first and second teeth includes a material engagement surface, a first side surface that faces the punch, and a second side surface that faces away from the punch, a rounded corner is located at an intersection between the material engagement surface and the first side surface that faces the punch, and a sharp corner is located at an intersection between the material engagement surface and the second side surface that faces away from the punch, the rounded corners of each of the first teeth are configured to face the sharp corner of an adjacent second tooth when the first and second teeth are engaged with the sheet, and a force exerted by the second cylinder is greater than that exerted by the first cylinder, and a force exerted by the cushion pin is greater than that exerted by the second cylinder;

moving the upper binder in a direction toward the punch such that the lower binder is moved by the second cylinder against the force exerted by the first cylinder to an extent that a gap is maintained between the first teeth and the second teeth that ensures that the first and second teeth do not grip the sheet material and permits the sheet material to be drawn in a direction toward the cavity;

continuing to move the upper binder toward the punch such that the lower binder is moved by the second cylinder against the force exerted by the first cylinder until the lower binder contacts the cushion pin, wherein upon contact by the lower binder with the cushion pin, the gap between the first and second teeth is removed such that the first and second teeth grip and hold the sheet material while permitting the sheet material to undergo final stretching until a final part is formed of the sheet material.

9. The method according to claim 8, wherein the first and second cylinders are selected from a group consisting of a nitrogen gas spring, a hydraulic cylinder, and a coil spring.

10. The method to claim 8, wherein the second teeth are part of an insert that is configured to be received within a recess of the lower binder.

11. The method according to claim 8, wherein the sharp corner is configured to bite into the sheet material during engagement between the upper teeth and the lower teeth with the sheet material located therebetween.

12. The method according to claim 11, wherein an angle between the material engagement surface and the second side surface lies in the range of seventy to ninety degrees.

13. The method according to claim 8, wherein the rounded corner is configured to bend the sheet material during engagement between the upper teeth and the lower teeth with the sheet material located therebetween.

14. The method according to claim 8, wherein the first and second teeth are configured to limit spring back of the sheet material.

* * * * *